US010111510B2

(12) United States Patent
Cheng

(10) Patent No.: US 10,111,510 B2
(45) Date of Patent: Oct. 30, 2018

(54) SYSTEMS AND DEVICES FOR COSMETIC POWDER ACCUMULATION MANAGEMENT

(71) Applicant: L'Oreal, Paris (FR)

(72) Inventor: Wenzhen Cheng, Clark, NJ (US)

(73) Assignee: L'Oreal, Paris (FR)

( * ) Notice: Subject to any disclaimer, the term of this patent is extended or adjusted under 35 U.S.C. 154(b) by 133 days.

(21) Appl. No.: 15/395,957

(22) Filed: Dec. 30, 2016

(65) Prior Publication Data

US 2018/0184783 A1 Jul. 5, 2018

(51) Int. Cl.

| | |
|---|---|
| ***B05C 11/10*** | (2006.01) |
| ***A45D 33/00*** | (2006.01) |
| ***A45D 33/02*** | (2006.01) |
| *A45D 33/08* | (2006.01) |

(52) U.S. Cl.

CPC ..... *A45D 33/006* (2013.01); *A45D 33/02* (2013.01); *A45D 33/025* (2013.01); *A45D 33/08* (2013.01)

(58) Field of Classification Search

CPC .... A45D 33/006; A45D 33/02; A45D 33/025; A45D 33/08

USPC ..... 401/4; 132/298, 299

See application file for complete search history.

(56) References Cited

U.S. PATENT DOCUMENTS 1,804,943 A * 5/1931 Maillard ..... A45D 33/025 132/299
1,814,747 A * 7/1931 Friedman ..... A45D 33/06 132/298
1,847,840 A * 3/1932 Levy ..... A45D 33/025 132/298
2,147,136 A 2/1939 Aizic
5,542,579 A * 8/1996 Robbins, III ..... B65D 41/26 222/158
8,066,019 B2 * 11/2011 Zhu ..... A45D 33/16 132/298

(Continued)

FOREIGN PATENT DOCUMENTS

| | | |
|---|---|---|
| DE | 393087 | 4/1924 |
| FR | 708344 | 4/1931 |

(Continued)

OTHER PUBLICATIONS

International Search Report and Written Opinion dated Feb. 28, 2018, issued in corresponding International Application No. PCT/US2017/068338, filed Dec. 22, 2017, 14 pages.

*Primary Examiner* — Jennifer C Chiang
(74) *Attorney, Agent, or Firm* — Christensen O'Connor Johnson Kindness PLLC

(57) ABSTRACT

Cosmetic powder containers with powder accumulation management systems are provided to reduce waste and mess related to the loss of cosmetic powder. In general, examples of systems described herein generally include a sifter positioned above the cosmetic powder with apertures configured for bi-directional pass-through of cosmetic powder. In some examples, the sifter is dome-shaped with a concave upper surface. To manage accumulation of cosmetic powder on an upper surface of the sifter, a sweeper projection is provided to collect cosmetic powder on the upper surface and direct the cosmetic powder toward the apertures of the sifter for pass-through back into the container. In this regard, accumulation of cosmetic powder on the upper surface of the sifter is managed, limiting waste and mess during use of the cosmetic powder.

20 Claims, 10 Drawing Sheets

(56) References Cited

U.S. PATENT DOCUMENTS

| | | | | |
|---|---|---|---|---|
| 8,235,059 | B2 * | 8/2012 | Pires | A45D 33/003 132/299 |
| 8,387,627 | B2 * | 3/2013 | Yeom | A45D 33/06 132/299 |
| 9,204,704 | B1 | 12/2015 | Wolfe | |
| 2012/0125361 | A1 * | 5/2012 | Yeom | A45D 33/025 132/293 |
| 2014/0246121 | A1 | 9/2014 | Henry et al. | |

FOREIGN PATENT DOCUMENTS

| | | | |
|---|---|---|---|
| FR | 718366 | | 11/1931 |
| WO | 2009010701 | A2 | 1/2009 |
| WO | 2016/171661 | A1 | 10/2016 |

* cited by examiner

SYSTEMS AND DEVICES FOR COSMETIC POWDER ACCUMULATION MANAGEMENT

SUMMARY

In an aspect, the present disclosure is directed to, among other things, representative embodiments of a cosmetic powder accumulation management system. The system generally includes a sifter positioned above the cosmetic powder with apertures configured for bi-directional pass-through of cosmetic powder. To manage accumulation of cosmetic powder on an upper surface of the sifter, a sweeper projection is provided to collect cosmetic powder on the upper surface and direct the cosmetic powder toward the apertures of the sifter for pass-through back into the container. In this regard, accumulation of cosmetic powder on the upper surface of the sifter is reduced, limiting waste and mess during use of the cosmetic powder.

In accordance with one embodiments described herein, a cosmetic powder accumulation management system is provided. The cosmetic powder accumulation management system generally includes a sifter having an upper surface and a plurality of apertures configured for pass-through of cosmetic powder, and a cover member positioned adjacent to the upper surface of the sifter, the cover member having a first sweeper projecting toward the sifter, wherein the first sweeper may be configured to direct the cosmetic powder on the upper surface toward the plurality of apertures upon rotation of the cover member.

In accordance with another embodiment described herein, a cosmetic powder container is provided. The cosmetic powder container generally includes a sifter positioned between a container body and a cap removably couplable to the container body, the sifter having a contoured upper surface and a plurality of apertures configured for pass-through of cosmetic powder, and a cover member coupled to the cap and positioned adjacent the contoured upper surface of the sifter, the cover member having a first sweeper projecting toward the sifter, wherein the first sweeper may be configured to direct the cosmetic powder on the contoured upper surface toward the plurality of apertures upon rotation of the cap such that the cosmetic powder passes through to the container body.

In accordance with any of the embodiments described herein, the upper surface of the sifter may be contoured.

In accordance with any of the embodiments described herein, the sifter may be dome-shaped and the contoured upper surface may be concave.

In accordance with any of the embodiments described herein, the cover member may be coupled to a cosmetic brush configured for application of the cosmetic powder to a skin portion In accordance with any of the embodiments described herein, the cosmetic powder accumulation management system may further include a second sweeper arranged in a circular arc around a center of the cover member, wherein the first sweeper and the second sweeper may be spaced 180° apart along the circular arc such that 180° rotation of the cover member results in a swept path of 360° of the circular arc In accordance with any of the embodiments described herein, the cosmetic powder accumulation management system may further include a third sweeper, a fourth sweeper, and a fifth sweeper evenly spaced and arranged in a circular arc around a center of the cover member, wherein the first, second, third, fourth, and fifth sweeper may be spaced 72° apart along the circular arc such that a 72° rotation of the cap results in a swept path of 360° of the circular arc In accordance with any of the embodiments described herein, the first sweeper may be arcuate.

In accordance with any of the embodiments described herein, the arc of the first sweeper may be concave in the direction of rotation of the cover member.

In accordance with any of the embodiments described herein, the first sweeper may abut the concave upper surface of the sifter during at least a portion of the rotation of the cover member.

In accordance with any of the embodiments described herein, the first sweeper may be manufactured from a material of one or more of High-Density Polyethylene (HDPE), Low-Density Polyethylene (LDPE), Linear Low-Density Polyethylene (LLDPE), rubber, Polypropylene (PP), nylon, Acrylonitrile Butadiene Styrene (ABS), Polybutylene Terephthalate (PBT), HYTREL®, and other thermo plastic or polymer.

In accordance with any of the embodiments described herein, the cap may further include a plurality of bristles extending away from the sweeper, the bristles configured for collection of cosmetic powder and subsequent application of the cosmetic powder to a skin portion.

In accordance with any of the embodiments described herein, the cosmetic powder container may further include a dust cap removably couplable to the cap, the dust cap configured to surround and protect the plurality of bristles.

In accordance with any of the embodiments described herein, the removable coupling of the cap to the container body may be a mechanical coupling selected from the group consisting of threads, press fit, turn-to-lock, and interlock.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The following description provides several examples that relate to systems and devices for cosmetic powder accumulation management, such as systems used with a cosmetic powder container. Application of cosmetic powder to skin is a common practice to tone the skin, set a foundation for further cosmetic application, hide skin flaws, and reduce the shiny appearance of skin, among other common uses. To apply the powder, a powder brush or applicator can be used. Generally described, a cosmetic powder container includes a body for housing the cosmetic powder and a cover to contain the cosmetic powder. In some embodiments, a powder brush is integrated into a component of the container.

In cosmetic powder containers, it is often desirable to include a planar sifter between the cosmetic powder in the body and the opening in the body to control and/or limit the amount of powder that is retained in the bristles of the brush. In the absence of a sifter, the brush would often collect excessive cosmetic powder, and the powder may be difficult to retain within the body. Generally, the sifter can include a plurality of apertures to allow for the restricted pass-through of cosmetic powder out of the container body for collection by the brush. The plurality of apertures also allow for the redeposit of excess cosmetic powder back into the container body. In the absence of a system to direct excess cosmetic powder toward the apertures, accumulation on the upper surface of the sifter creates a mess upon the opening of the cover and wastes product. The accumulation of excess powder is especially problematic when the container is stored upside-down, for example, while in a makeup bag or travel container. Therefore, a need exists for cosmetic powder accumulation management in order to reduce the mess and waste associated with conventional powder containers.

Figure 1:
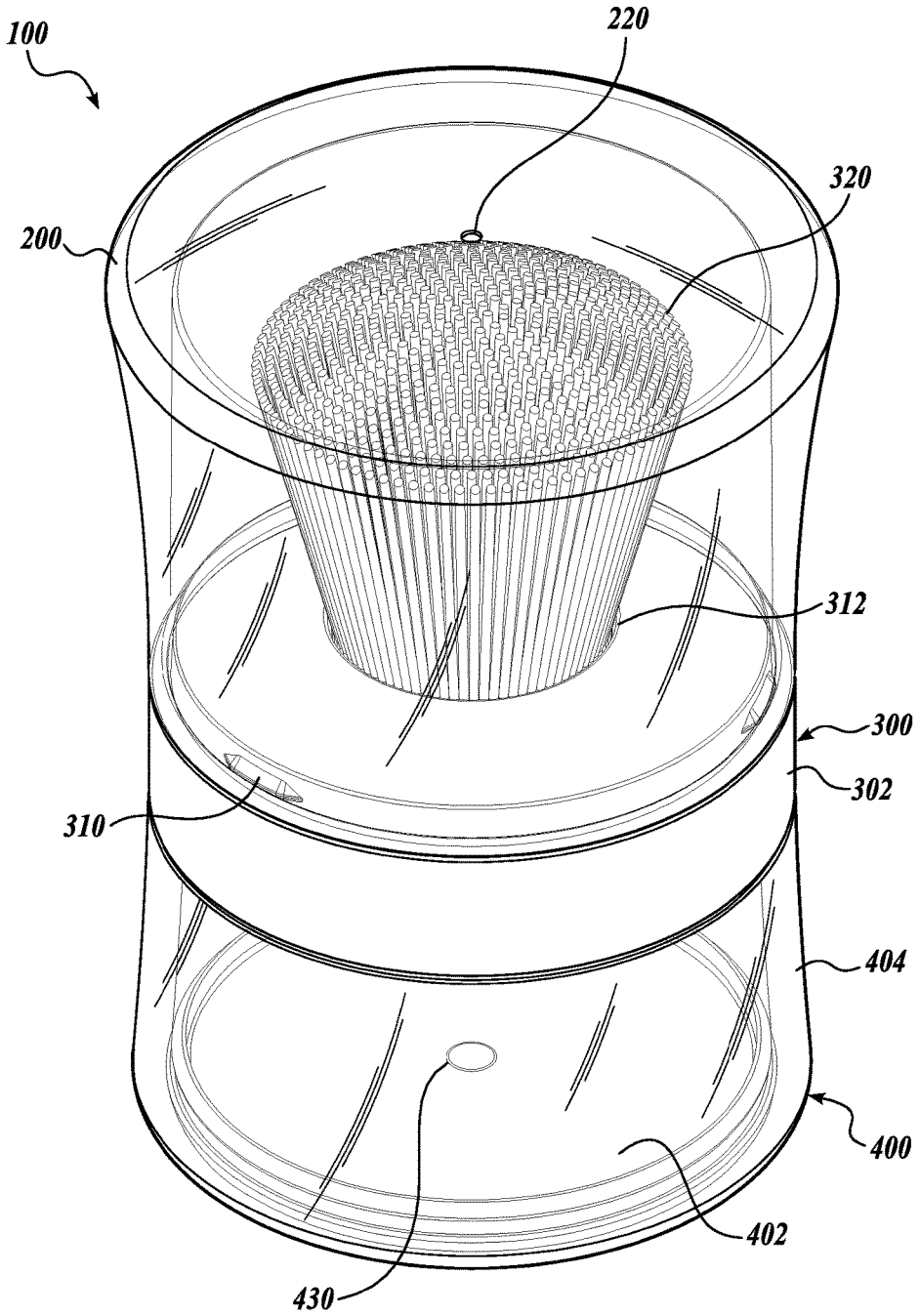
FIG. 1 is a front top perspective view of one representative embodiment of a cosmetic powder container in accordance with an aspect of the present disclosure.
Figure 2:
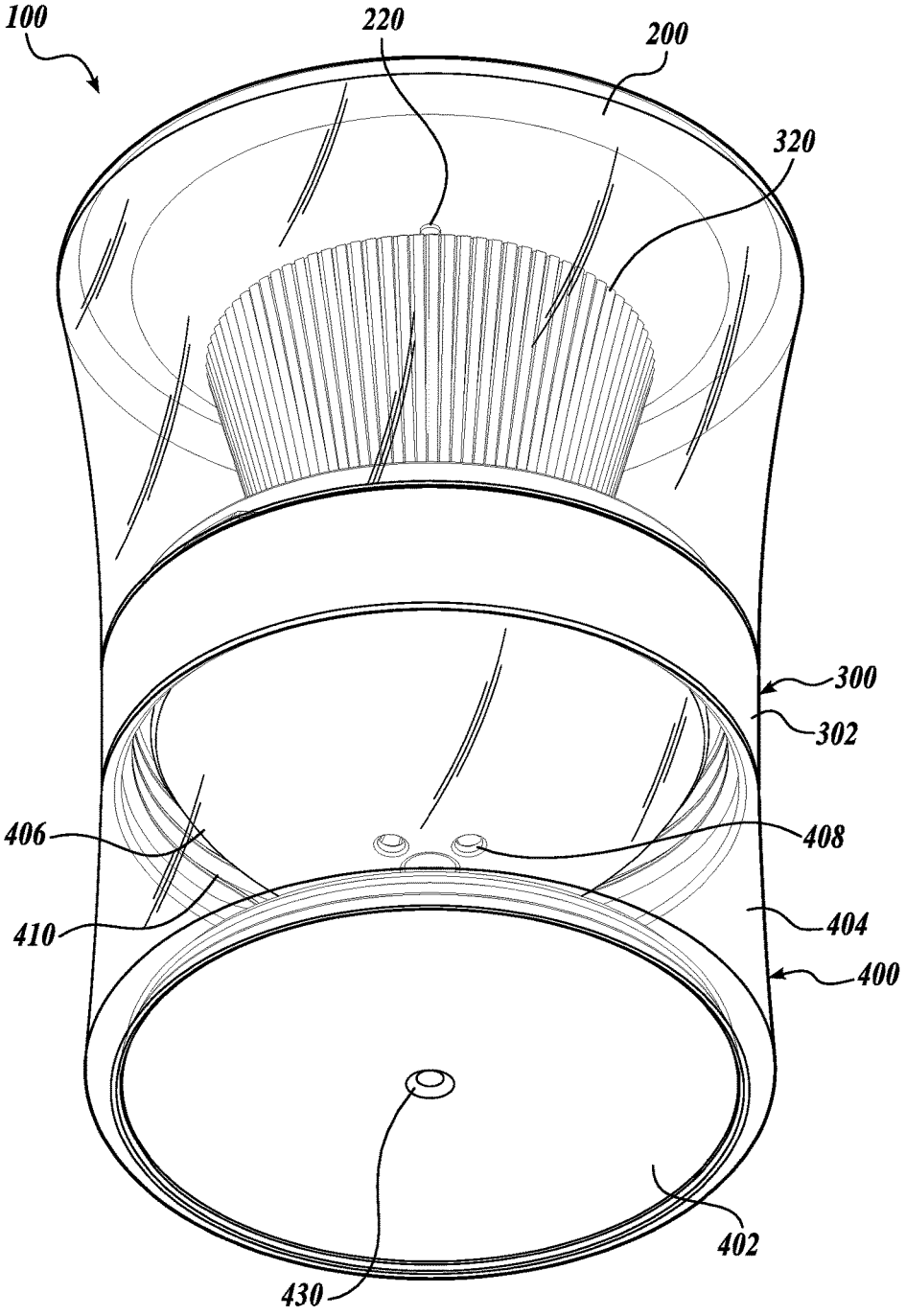
FIG. 2 is a front bottom perspective view of the cosmetic powder container of FIG. 1.

FIG. 1 shows one representative embodiment of a cosmetic powder container in accordance with an aspect of the disclosure, for implementing one or more inventive methodologies or technologies such as, for example, providing a system for reducing or preventing the accumulation of cosmetic powder on, e.g., the upper surface of the sifter. Conventional cosmetic powder containers are generally poor at returning accumulated cosmetic powder to the container body. As a result, each opening of the container may cause waste of cosmetic powder and excess cosmetic powder taken up by the application brush.

Accordingly, to address the deficiencies of conventional applicators, and/or others, embodiments of the present disclosure relate to a cosmetic powder container with a sifter configuration that promotes the return of accumulated cosmetic powder to the container base upon opening of the cover. In some embodiments disclosed herein, return of accumulated cosmetic powder to the container base is also achieved during manipulation of the cosmetic powder with the application brush.

Embodiments of the cosmetic powder accumulation management system disclosed herein are suitable for use with standard cosmetic powder containers, among others. In one embodiment, the cosmetic powder container generally includes a container body and an inner cavity configured to store a quantity of cosmetic powder. The upper portion of the body is configured to interface with a cover in a removably couplable manner for enclosing the cosmetic powder within the container for storage or travel. In one embodiment, the cover is adapted to be coupled to an applicator brush. In certain embodiments disclosed herein, the cosmetic powder container is about 15 centimeters or smaller in height, about 7.5 centimeters or smaller in width or diameter, and contains less than 20 ounces by weight (oz.) of cosmetic powder. In an embodiment, a major dimension of the cosmetic powder container ranges from about 2 centimeters to about 15 centimeters. In an embodiment, a major dimension of the cosmetic powder container ranges from about 2 centimeters to about 7 centimeters. In an embodiment, the volume of the inner cavity of the cosmetic powder container ranges in size suitable to contain about 0.05 ounces by weight (oz.) to about 20 oz. In an embodiment, the volume of the inner cavity of the cosmetic powder container ranges in size suitable to contain about 0.08 ounces by weight (oz.) to about 3 oz. In an embodiment, the volume of the inner cavity of the cosmetic powder container ranges in size suitable to contain about 0.08 ounces by weight (oz.) to about 1 oz. In an embodiment, the volume of the inner cavity of the cosmetic powder container ranges in size suitable to contain about 0.08 ounces by weight (oz.) to about 0.5 oz. In an embodiment, the volume of the inner cavity of the cosmetic powder container ranges in size suitable to contain about 0.30 ounces by weight (oz.) to about 0.40 oz.

Referring to FIGS. 1-4, there is shown one embodiment of a cosmetic powder container, generally designated 100, in accordance with one or more aspects of the present disclosure. In the illustrated embodiment, the cosmetic powder container 100 generally includes a dust cap 200, a cover assembly 300, and a container base assembly 400. In some embodiments, the cover assembly 300 may include an applicator brush 320 for applying cosmetic powder P (see FIG. 5) to a skin portion (not shown). When assembled, the dust cap 200 is removably coupled to the cover assembly 300 in order to surround and provide protection to the applicator brush 320. It will be appreciated in some embodiments that the dust cap 200 can be directly coupled to the container base assembly 400, or omitted altogether. Each component of the cosmetic powder container 100 will now be described in greater detail.

Figure 3:
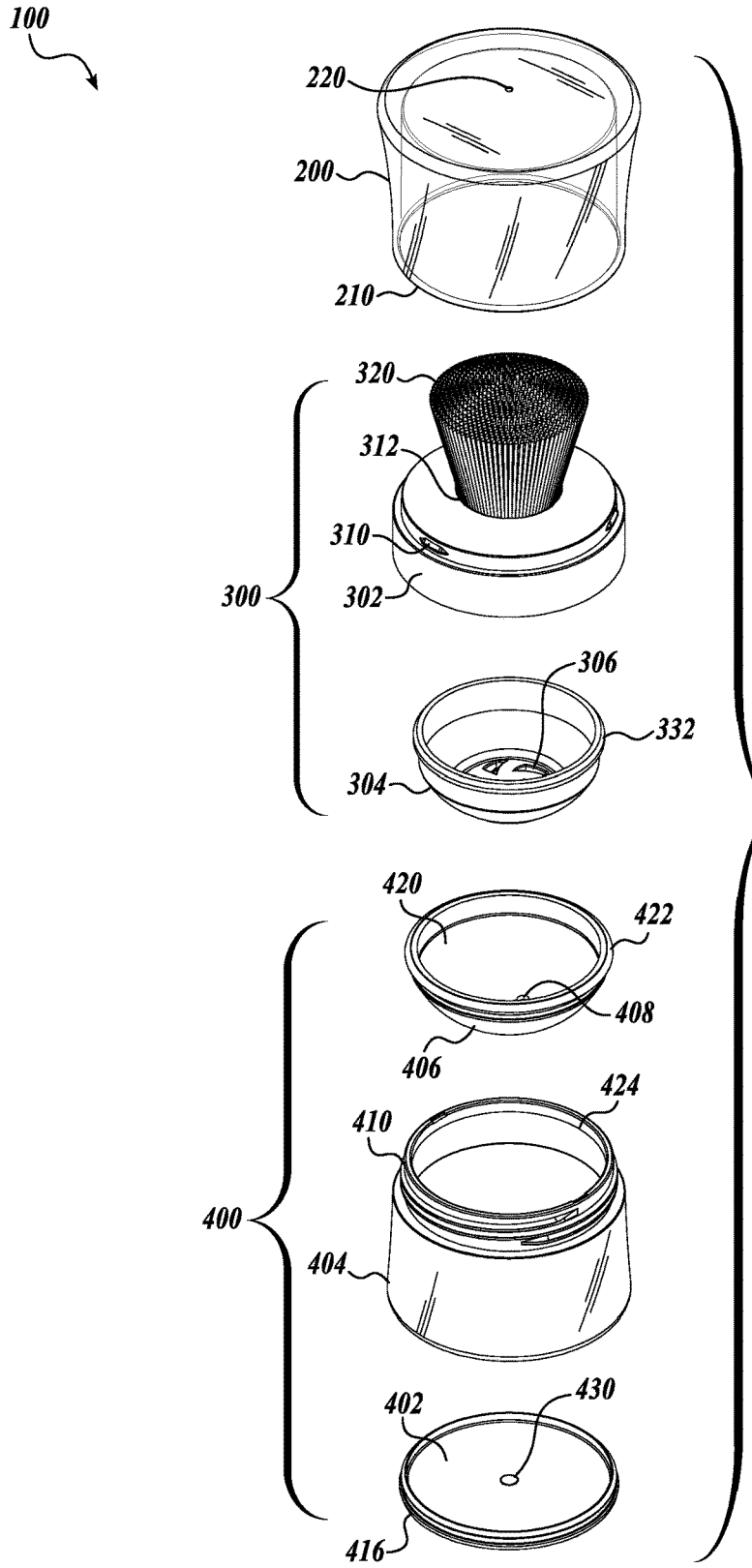
FIG. 3 is a front top exploded perspective view of the cosmetic powder container of FIG. 1.
Figure 4:
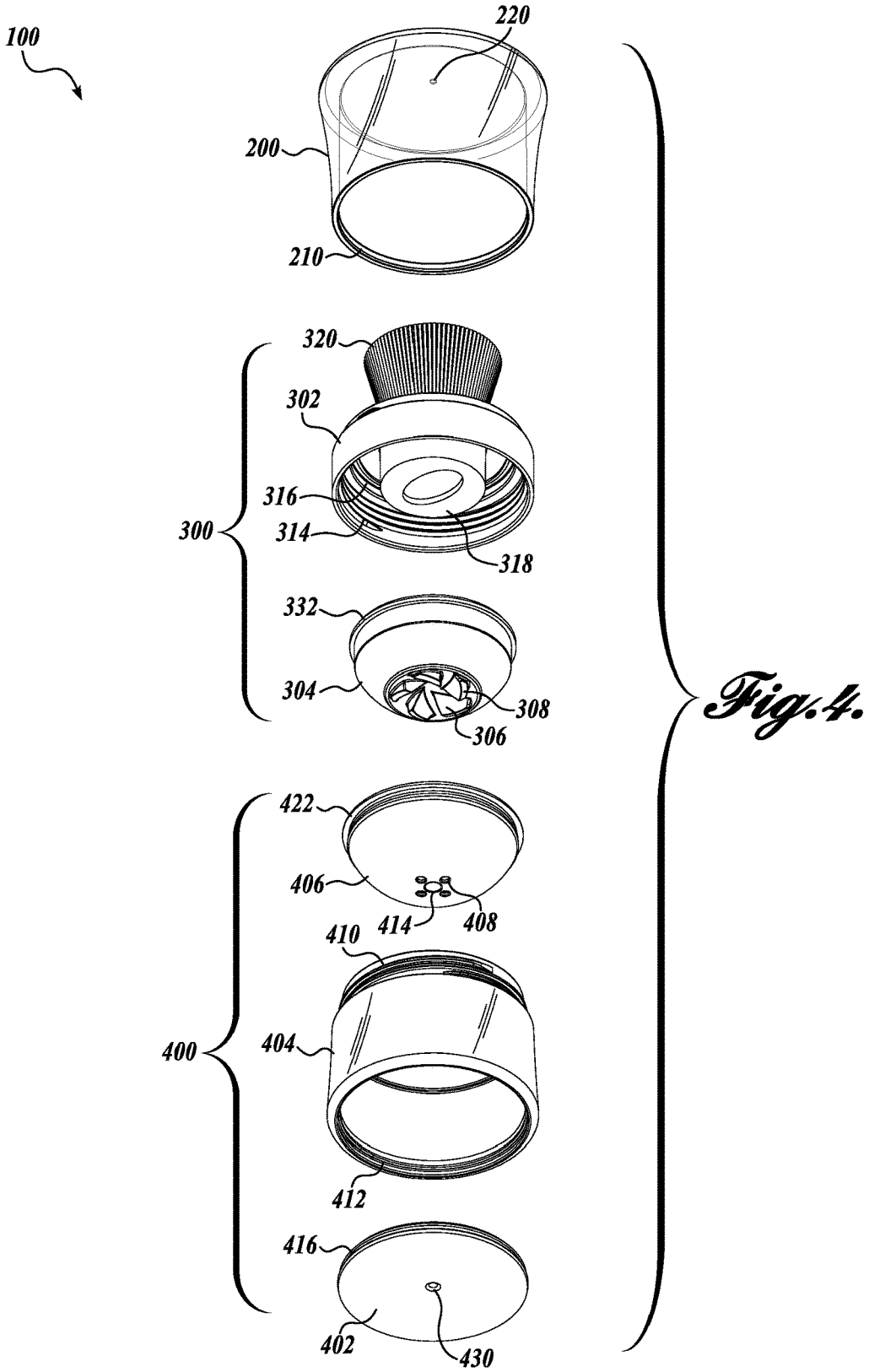
FIG. 4 is a front bottom exploded perspective view of the cosmetic powder container of FIG. 1.
Figure 5:
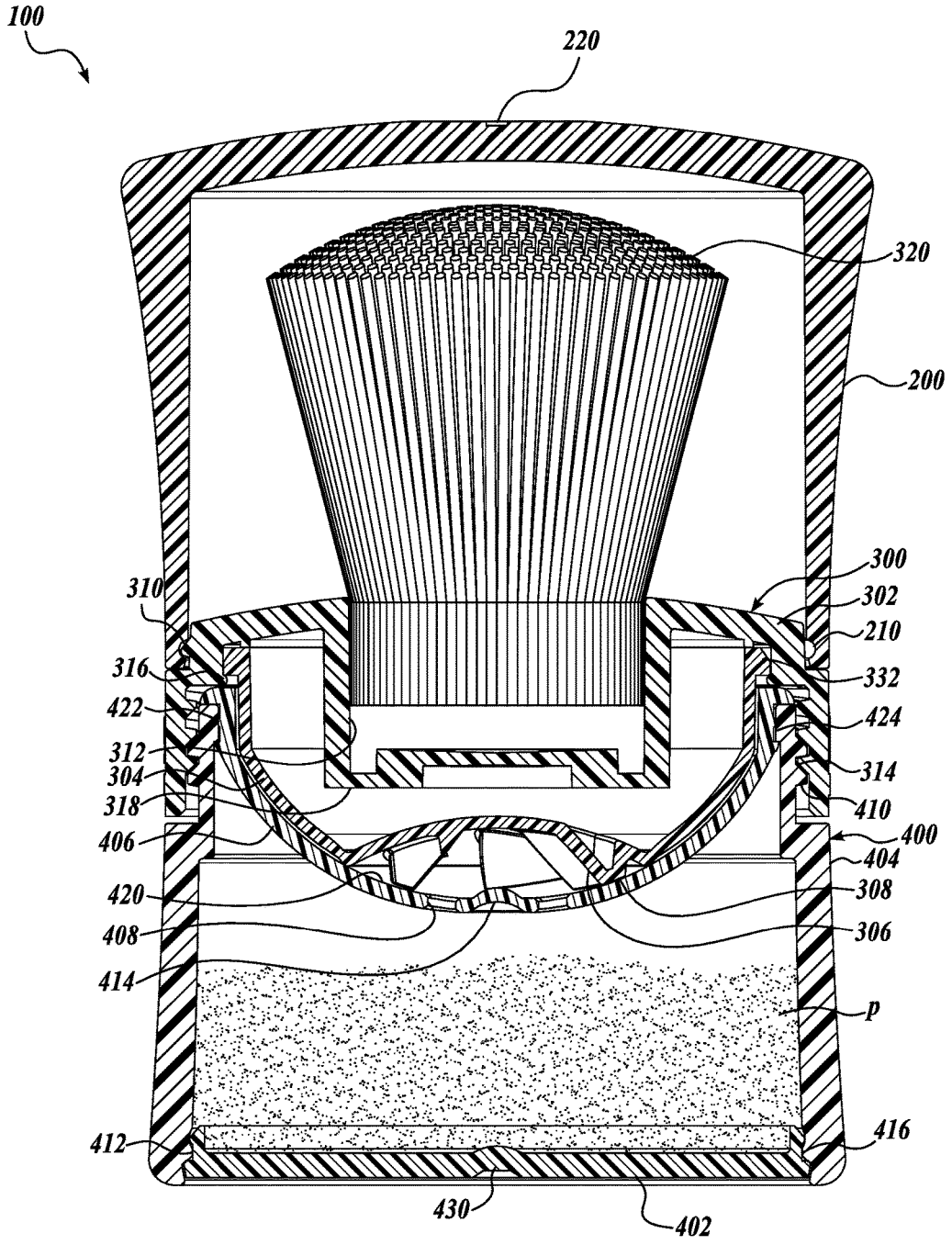
FIG. 5 is a front cross-sectional view of the cosmetic powder container of FIG. 1.

As shown in FIGS. 3 and 4, the dust cap 200 includes a cap coupling rim 210 that interfaces with a coupling protrusion 310 located on the cover assembly 300 to removably couple the dust cap 200 to the cover assembly 300. In some embodiments, if manufactured using an injection molding method, an injection molding gate relief 220 may be added to the dust cap 200 to minimize the appearance of a gate defect for aesthetic purposes.

The cover assembly 300 includes a cover portion 302 that is configured to be removably coupled to the container base assembly 400 to retain the cosmetic powder P within the container base assembly 400 when the cosmetic powder container 100 is transported or otherwise not in use. In this regard, in some embodiments, the cover portion 302 includes cover threads 314 that correspond to base threads 410 of the container base assembly 400 in order to form a detachable coupling interface. In other embodiments, the cover portion 302 is removably couplable to the container base assembly 400 with other non-permanent methodologies, including press fit, turn-to-lock features, and/or interlock features, among others.

In some embodiments, the cover assembly 300 integrates the applicator brush 320 by coupling the application brush 320 within an upper brush cavity 312 of a brush projection 318 (see FIG. 4) in the cover portion 302. The applicator brush 320 is configured to retain an amount of the cosmetic powder P when put in contact with the cosmetic powder P, and to subsequently release the cosmetic powder P when the applicator brush 320 is applied to the skin portion. In other embodiments, the applicator brush 320 is a separate component and is suitably coupled to any other component of the cosmetic powder container 100, or is offered as a standalone component with or without the cosmetic powder container 100. Although not shown in the FIGURES, in embodiments of the cosmetic powder container 100, the bristles of the applicator brush are suitably fixedly secured within the upper brush cavity 312 by any suitable method, such as with an adhesive, by friction through compression, crimping of the bristles, stapling, etc.

Figure 6:
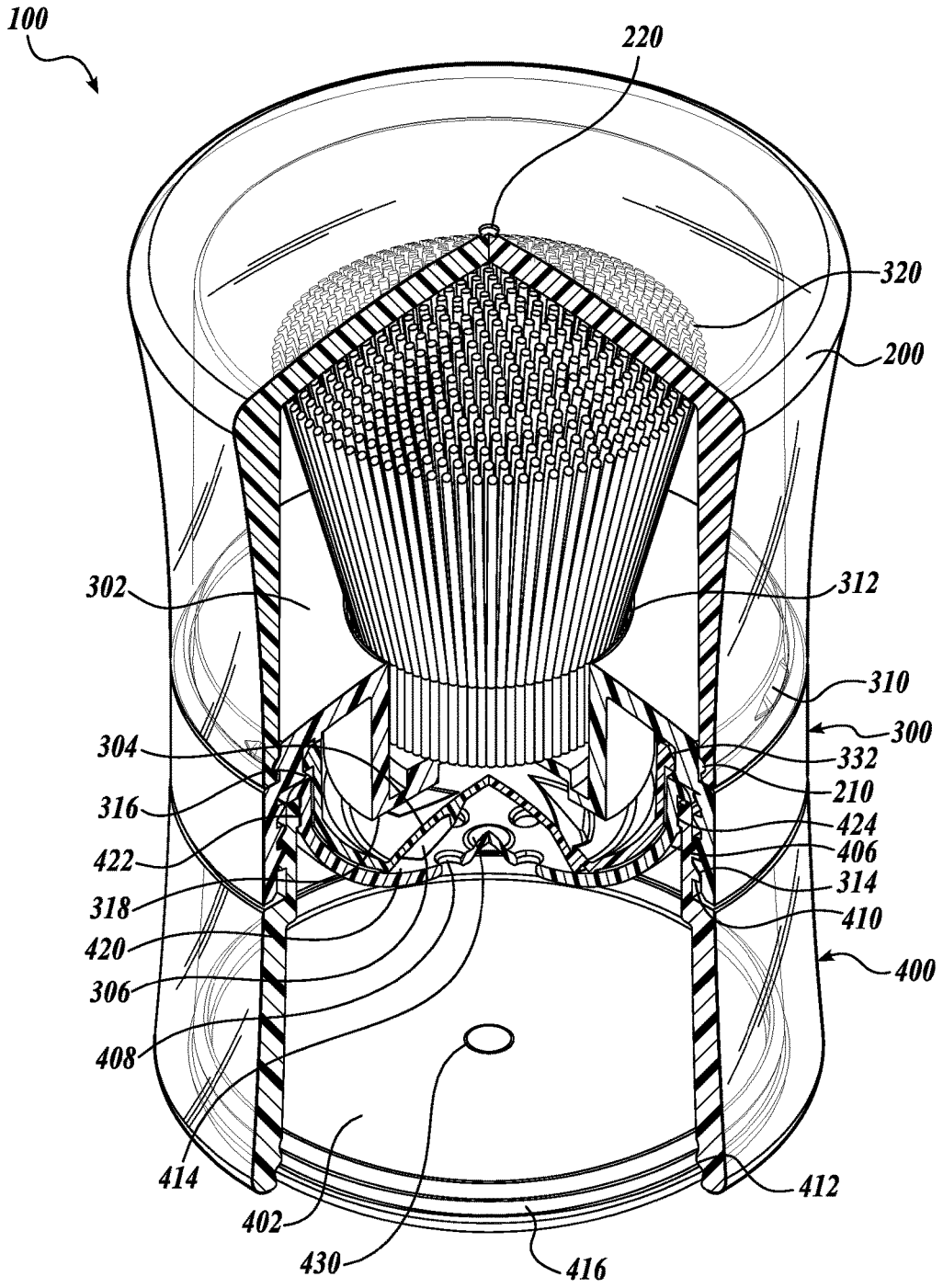
FIG. 6 is a front top angular cross-sectional view of the cosmetic powder container of FIG. 1.

In the illustrated embodiments, the cover assembly 300 further includes a sweeper member 304 couplable to the cover portion 302. As shown most clearly in FIGS. 5 and 6, the sweeper member 304 includes a sweeper member coupling lip 332 that interfaces with a corresponding cover member coupling lip 316 in order to detachably secure the sweeper member 304 to the cover portion 302. In other embodiments, the sweeper member 304 is suitably coupled to the cover member using any suitable method. The sweeper member 304 includes a sweeper projection 306 having a sweeper projection distal end 308. As shown in FIG. 4, the sweeper member 304 includes a plurality of sweeper projections 306, generally arranged in a circular pattern around a center of the sweeper member 304. In some embodiments, the sweeper member 304 includes a single sweeper projection 306. In other embodiments, two or more sweeper projections 306 are included with the sweeper member 304. The configuration and effect of the sweeper projection 306 will be discussed in greater detail below.

In some embodiments, the sweeper projection 306 is manufactured from a material of one or more of High-Density Polyethylene (HDPE), Low-Density Polyethylene (LDPE), Linear Low-Density Polyethylene (LLDPE), rubber, Polypropylene (PP), nylon, Acrylonitrile Butadiene Styrene (ABS), Polybutylene Terephthalate (PBT), HYTREL®, and other thermo plastic or polymer.

Still referring to FIGS. 1-4, the container base assembly 400 generally includes a container base 402, a container body 404, and a sifter 406. The container base 402 and the container body 404 together form an inner cavity suitable for the retention and storage of cosmetic powder P. In some embodiments, the container base 402 is couplable to the container body 404 using a container base coupling lip 416 that interfaces with a corresponding container body lower coupling lip 412 in order to be detachably coupled thereto. In that regard, the container base 402 is generally intended to be detached during manufacturing for filling of the container base assembly 400 with cosmetic powder P. In other embodiments, any suitable coupling is used between the container base 402 and the container body 404. In further embodiments, the container base 402 and the container body 404 are formed as a single component. In some embodiments, if manufactured using an injection molding method, an injection molding gate relief 430 may be added to the container base 402 to minimize the appearance of a gate defect for aesthetic purposes.

The sifter 406 is detachably couplable to the container body 404 using a sifter coupling lip 422 that interfaces with a corresponding container body upper coupling lip 424. In other embodiments, any suitable coupling is used between the sifter 406 and the container body 404. In further embodiments, the sifter 406 and the container body 404 are formed as a single component. As can be appreciated, the sifter 406 limits the flow rate of cosmetic powder P through the opening in the container body 404 such that the cosmetic powder P is generally contained in the inner cavity of the container base assembly 400 until an amount is needed for use. In this regard, the sifter 406 is configured to control the flow of and limit the quantity of cosmetic powder P available to be taken up by the applicator brush 320 during use.

In the embodiments disclosed herein, the sifter 406 is suitably planar or contoured. In embodiments with a contoured sifter 406, any suitable contour is within the scope of the present disclosure. In the illustrated embodiments, the sifter 406 has a contour that is generally dome-shaped and includes an upper concave surface 420 and a plurality of apertures 408 arranged near the lowest point of the sifter 406, i.e., toward the center area of the sifter 406. In some embodiments, an upward curving dimple 414 may be added to the sifter 406 to minimize the accumulation of cosmetic powder P on the interior surface between the plurality of apertures 408. In this regard, the upward curving dimple 414 tends to direct the cosmetic powder P away from the center and toward the plurality of apertures 408 and the swept path of the sweeper projection 306.

In the dome-shaped sifter embodiment, the shape of the upper concave surface 420 promotes gravity-assisted migration of the cosmetic powder P toward the lowest point of the concave surface 420 when the cosmetic powder container 100 is upright. In this regard, the cosmetic powder P on the upper concave surface 420 tends to migrate toward the plurality of apertures 408 for pass-through back into the inner cavity of the container base assembly 400. In another embodiment, the upper concave surface 420 may generally correspond to the shape of the bristles of the applicator brush 320 to allow the bristles to gather and retain a more evenly dispersed quantity of the cosmetic powder P.

In other embodiments, the sifter 406 has any suitable contour configured to limit the flow rate of cosmetic powder P through the opening in the container body 404. Although the tendency of the cosmetic powder P to migrate toward the sifter apertures 408 may be enhanced by the inclusion of a low point in the sifter 406, a dome shape affects the capacity of the inner cavity of the container base assembly 400. In some embodiments, a planar sifter may be included in the cosmetic powder container 100. In embodiments with a planar sifter, benefits of the cosmetic powder management system of the present disclosure will still be attained.

Figure 7A:
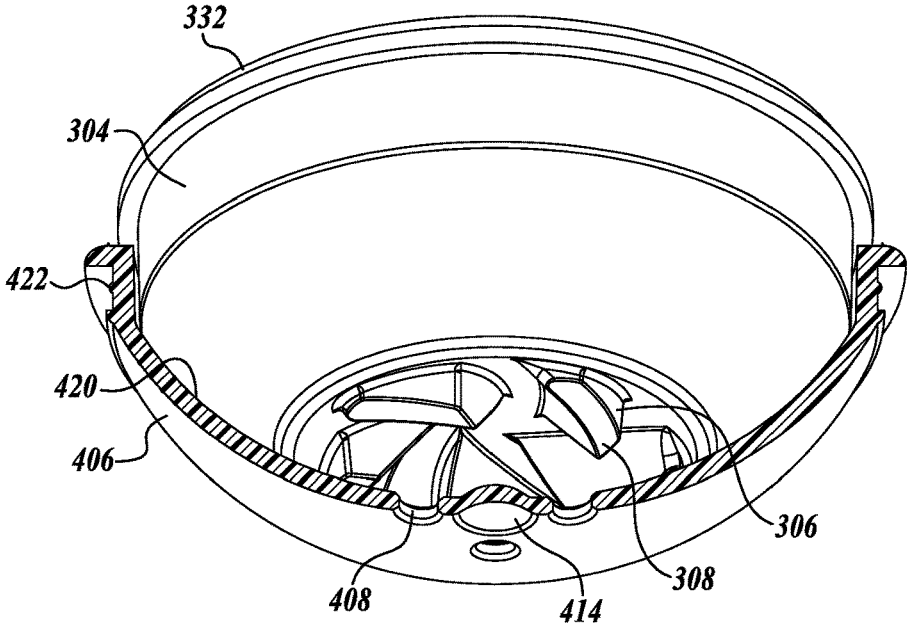
FIG. 7*a* is a front bottom perspective view of one representative embodiment of a sifter and a sweeper, showing the sifter in cross-section, in accordance with an aspect of the present disclosure.
Figure 7B:
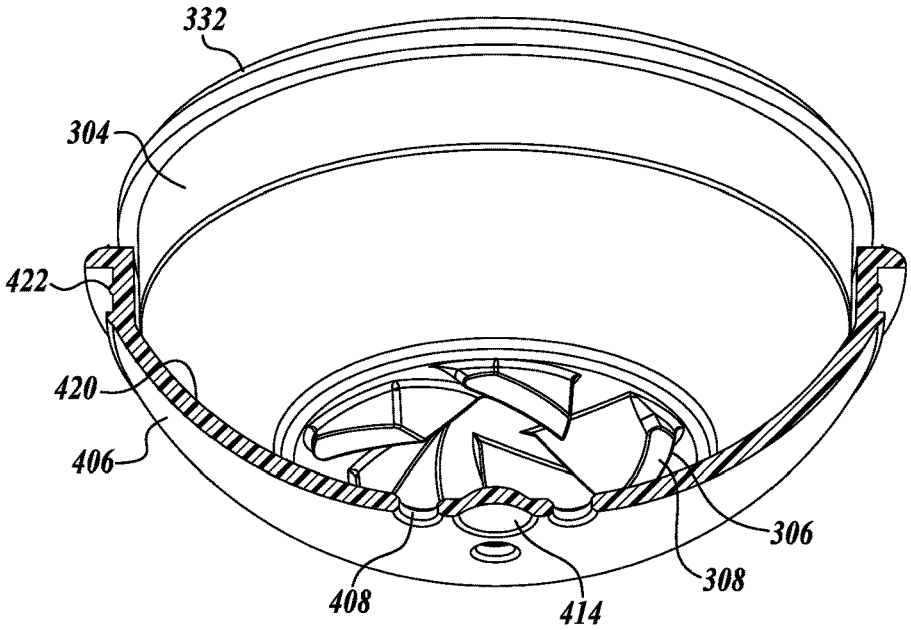
FIG. 7*b* is a front bottom perspective view of the sifter and the sweeper of FIG. 7*a*, showing the sifter in cross-section and the sweeper rotated with respect to the sifter.

The sweeper projection 306, and the interaction of the sweeper projection 306 with the sifter 406, will now be described in greater detail. As introduced above, the sweeper member 304 includes the sweeper projection 306 having the sweeper projection distal end 308. In the illustrated embodiments, the sweeper member 304 is coupled to the cover portion 302 such that the sweeper moves in conjunction with the other components of the cover assembly 300. As shown most clearly in FIGS. 5, 7*a*, and 7*b*, in some embodiments, when the cover assembly 300 is secured to the container base assembly 400, such as by engagement of the cover threads 314 with the base threads 410, the sweeper projection distal end 308 of the sweeper projection 306 abuts the upper concave surface 420 of the sifter 406. In other embodiments, the sweeper projection 306 is suitably spaced a distance away from the upper concave surface 420. In another use, the sweeper projection 306 can also provide a separating effect for the cosmetic powder P if moisture is absorbed by the cosmetic powder P and caking occurs.

The aspects of the sweeper projection 306 and the effect on the sweeper member 304 on the cosmetic powder P will now be explained in greater detail. As described above, during use of conventional cosmetic powder containers, cosmetic powder has a tendency to accumulate on the upper surface of the planar sifter, which can create a loss of cosmetic powder and/or cause the applicator brush to collect excessive cosmetic powder, leading to heavier transfer of cosmetic powder to the skin portion than may be desired. To manage the accumulation of the cosmetic powder P, the sweeper member 304 is configured to catch and direct cosmetic powder P toward the plurality of apertures 408 for pass-through into the cavity of the container base assembly 400. In some embodiments, the sweeper member 304 is coupled to the cover assembly 300. The desired movement of the cosmetic powder P toward the plurality of apertures 408 can be accomplished, for example, as the cover assembly 300 is unscrewed from the container base assembly 400, as would be normal during the opening of the cosmetic powder container 100 before use.

Figure 8A:
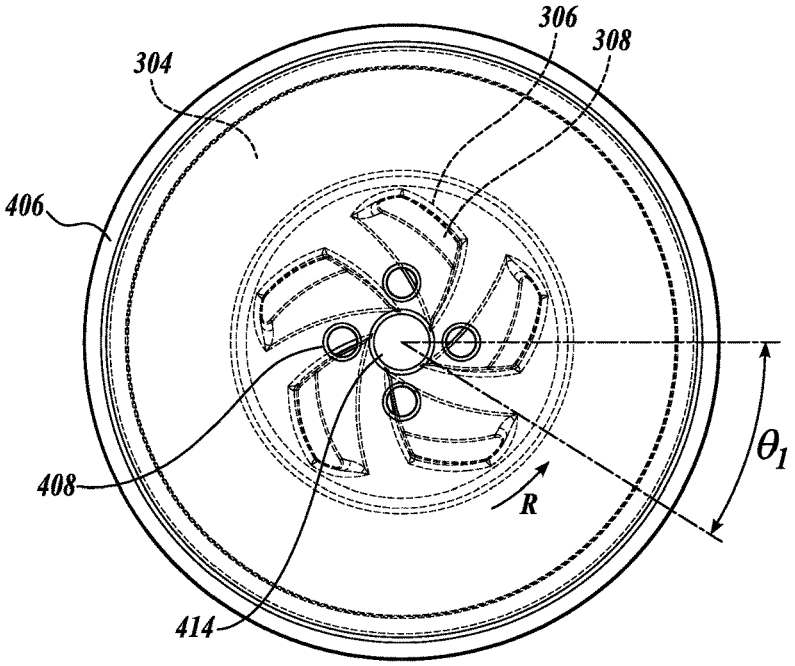
FIG. 8*a* is a bottom view of the sifter and the sweeper of FIG. 7*a*, showing the sweeper in broken line.
Figure 8B:
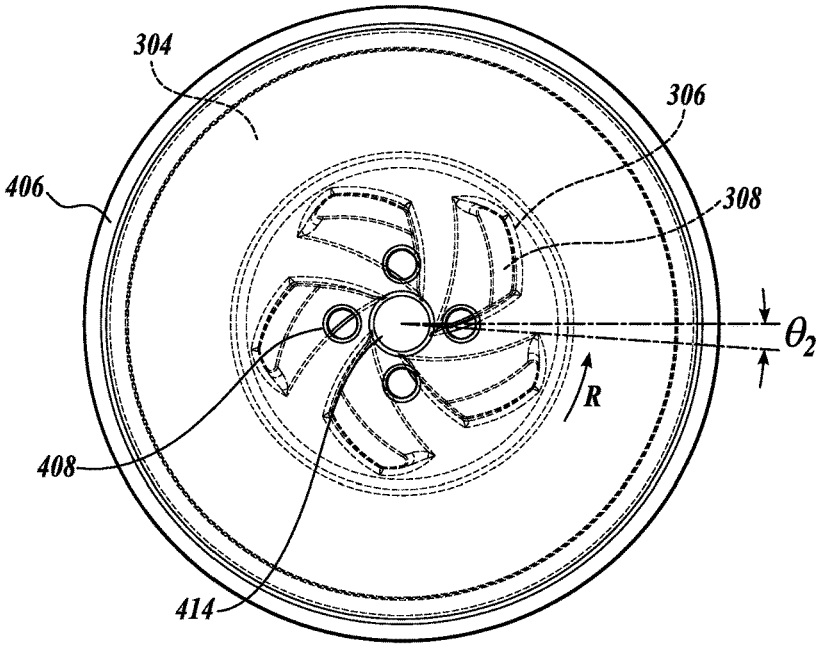
FIG. 8*b* is a bottom view of the sifter and the sweeper of FIG. 7*a*, showing the sweeper in broken line and the sweeper rotated with respect to the sifter.
Figure 9A:
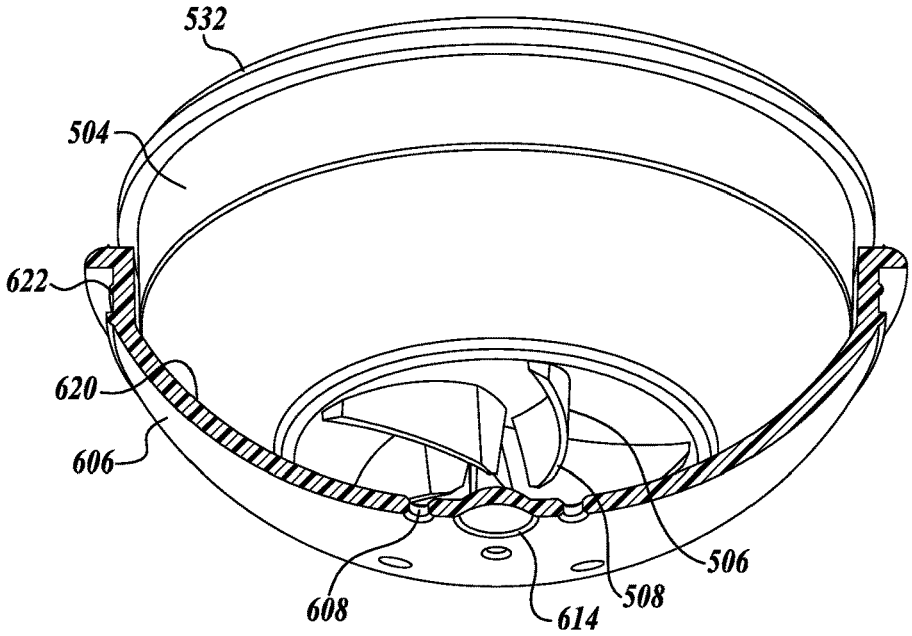
FIG. 9*a* is a front bottom perspective view of another representative embodiment of a sifter and a sweeper, showing the sifter in cross-section, in accordance with an aspect of the present disclosure.
Figure 9B:
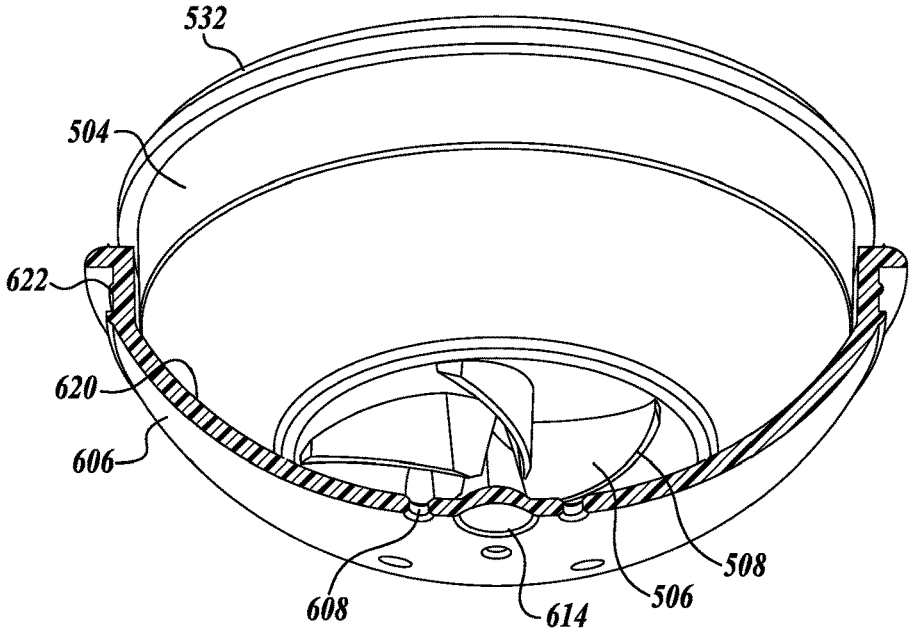
FIG. 9*b* is a front bottom perspective view of the sifter and the sweeper of FIG. 9*a*, showing the sifter in cross-section and the sweeper rotated with respect to the sifter.
Figure 10A:
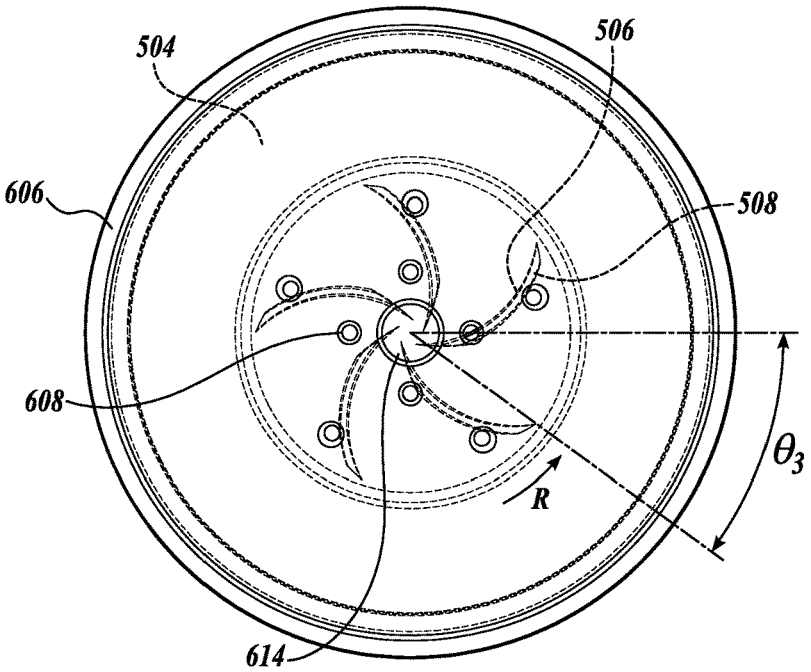
FIG. 10*a* is a bottom view of the sifter and the sweeper of FIG. 9*a*, showing the sweeper in broken line.
Figure 10B:
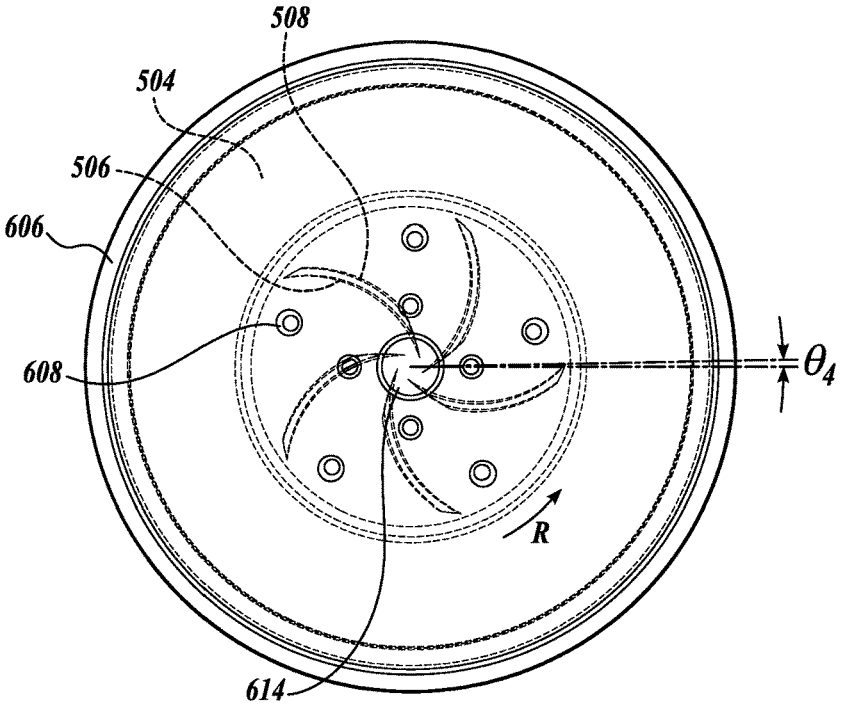
FIG. 10*b* is a bottom view of the sifter and the sweeper of FIG. 9*a*, showing the sweeper in broken line and the sweeper rotated with respect to the sifter.

As the cover assembly 300 is unscrewed, the sweeper member 304 rotates about a central axis defined by the center point of the threaded coupling of the cover threads 314 with the base threads 410. As the sweeper member 304 rotates, the sweeper projection distal end 308 of the sweeper projection 306 sweeps along the upper concave surface 420 of the container base assembly 400. As a result of the concave curvature of the sweeper projection 306 in the direction of rotational travel (see FIGS. 8*a* and 8*b*), the sweeping motion tends to capture and direct the cosmetic powder P inward toward the plurality of apertures 408 positioned near the center of the sifter 406. For example, as can be seen from the counter-clockwise transition from FIG. 8*a* to FIG. 8*b*, the sweeper member 304 begins at a rotational position with an angle of $\theta_1$ (FIG. 8*a*) between two reference points, and ends at a rotational position with an angle of $\theta_2$ between the same two reference points. As the rotational position is changed in a counter-clockwise direction, the curvature and skew of the sweeper projection 306 directs the cosmetic powder P toward the plurality of apertures 408 in the sifter 406.

The aforementioned sweeper configuration is illustrated in conjunction with the dome-shaped sifter 406. However, as previously mentioned, in other embodiments, the sweeper configuration is suitable for use with planar sifters, or sifters of any surface curvature configuration. In embodiments described herein, any number of sweeper projections may be used with the cosmetic powder container 100. As shown in the FIGURES, the sweeper member 304 includes five evenly spaced sweeper projections 306. However, in other embodiments, less than five sweeper projections 306 are suitably used. Likewise, in further embodiments, more than five sweeper projections 306 are suitably used. In this regard, the quantity of sweeper projections is generally optimized to allow for sweeping motion of a percentage of the length around the central axis.

Since the configuration of the threaded coupling of the cover threads 314 with the base threads 410 tends to create separation between the sweeper member 304 and the sifter 406, one aspect of specifying the quantity of sweeper projections is the desired amount of swept path the sweeper projection distal ends 308 will cover before the distal ends 308 are pulled out of contact with the sifter 406. However, in other embodiments with turn-to-lock features (not shown) between the cover assembly 300 and the container base assembly 400, the turn-to-lock features can be suitably configured such that the cover assembly 300 and the container base assembly 400 are at a constant distance during a portion of the turning of the cover assembly. In this regard, the sweeper projection distal ends 308 can be configured to remain in contact with the sifter 406 for a specified portion of the rotation of the cover assembly 300 during removal from the container base assembly 400.

In some embodiments, the sweeper projections 306 are evenly spaced in a circular swept path around the center of the sweeper member 304. In an evenly spaced configuration, the angle between common points on each sweeper projection 306 is calculated by dividing 360° by the number of sweeper projections 306. In this regard, if three sweeper projections 306 are included, the spacing is 120°. Likewise, if four sweeper projections 306 are included, the spacing is 90° between each sweeper projection 306. As in the illustrated embodiments, if five sweeper projections 306 are included, the spacing is 72° between each sweeper projection 306. In other embodiments, the sweeper projections 306 may have any suitable uneven spacing.

As a result of the cosmetic powder management described above, each time the cosmetic powder container 100 is opened for use, the system directs excess cosmetic powder P to the plurality of apertures 408 for pass-through into the cavity of the container base assembly 400.

Turning now to FIGS. 9*a*, 9*b*, 10*a*, and 10*b*, alternate embodiments of a sweeper member 530 and a sifter 608 are depicted and will now be described in detail. Certain components of the sweeper member 530 and the sifter 608 are substantially similar to the sweeper member 304 and the sifter 406 as outlined above, and as such, the remaining components of the cosmetic powder container 100 have not been shown in detail. Accordingly, the sweeper member 530 includes a sweeper member coupling lip 532 that, like the sweeper member coupling lip 332, interfaces the corresponding cover member coupling lip 316. The sweeper member 530 includes a sweeper projection 506 with a sweeper projection distal end 508.

The sifter 608 is generally dome-shaped and includes an upper concave surface 620 and a plurality of apertures 606 arranged near the lowest point of the sifter 608, i.e., the center area of the sifter 608. The sifter 608, like the sifter 406, is couplable to the container body 404 using a sifter coupling lip 622 that interfaces the corresponding container body upper coupling lip 424. In some embodiments, an upward curving dimple 614 may be added to the sifter 608 to minimize the accumulation of cosmetic powder P on the inner surface between the plurality of apertures 606. In this regard, the upward curving dimple 614 directs the cosmetic powder P away from the center and toward the plurality of apertures 606.

The sweeper projection 506 is similar to the sweeper projection 306 except that the sweeper projection 506 is generally thinner in the direction of travel. As a result, the sweeper projection 506 is configured to deflect such that contact with the upper concave surface 620 is maintained for a longer distance of rotation of the cover assembly 300.

Since the threaded coupling of the cover threads 314 with the base threads 410 draws the sweeper projection 506 away from the upper concave surface 620 as the cover assembly 300 is unscrewed, an initial deflection of the sweeper projection 506 can result in extended contact by the sweeper projection distal end 508 as the deflection relaxes to a neutral position during the sweep. As with the initial embodiments described above, the sweeper member 530 is also suitably used with planar sifters, or sifters having any suitable surface curvature configuration. In another use, the sweeper projection 506 can also provide a separating effect for the cosmetic powder P if moisture is absorbed by the cosmetic powder P and caking occurs.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "right hand," "left hand," "lateral," "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A cosmetic powder accumulation management system, comprising:

a sifter having an upper surface and a plurality of apertures configured for pass-through of cosmetic powder; and a cover member positioned adjacent to the upper surface of the sifter, the cover member having a first sweeper projecting toward the sifter, wherein the first sweeper is configured to direct the cosmetic powder on the upper surface toward the plurality of apertures upon rotation of the cover member.

2. The cosmetic powder accumulation management system of claim 1, wherein the upper surface of the sifter is contoured.

3. The cosmetic powder accumulation management system of claim 1, wherein the sifter is domed-shaped and the contoured upper surface is concave.

4. The cosmetic powder accumulation management system of claim 1, wherein the cover member is coupled to a cosmetic brush configured for application of the cosmetic powder to a skin portion.

5. The cosmetic powder accumulation management system of claim 1, further comprising a second sweeper arranged in a circular arc around a center of the cover member, wherein the first sweeper and the second sweeper are spaced 180° apart along the circular arc such that 180° rotation of the cover member results in a swept path of 360° of the circular arc.

6. The cosmetic powder accumulation management system of claim 5, further comprising a third sweeper, a fourth sweeper, and a fifth sweeper evenly spaced and arranged in a circular arc around a center of the cover member, wherein the first, second, third, fourth, and fifth sweeper are spaced 72° apart along the circular arc such that a 72° rotation of the cap results in a swept path of 360° of the circular arc.

7. The cosmetic powder accumulation management system of claim 1, wherein the first sweeper is arcuate.

8. The cosmetic powder accumulation management system of claim 7, wherein the arc of the first sweeper is concave in the direction of rotation of the cover member.

9. The cosmetic powder accumulation management system of claim 1, wherein the first sweeper abuts the concave upper surface of the sifter during at least a portion of the rotation of the cover member.

10. The cosmetic powder accumulation management system of claim 1, wherein the first sweeper is manufactured from a material of one or more of High-Density Polyethylene (HDPE), Low-Density Polyethylene (LDPE), Linear Low-Density Polyethylene (LLDPE), rubber, Polypropylene (PP), nylon, Acrylonitrile Butadiene Styrene (ABS), Polybutylene Terephthalate (PBT), HYTREL®, and other thermo plastic or polymer.

11. A cosmetic powder container, comprising:

a sifter positioned between a container body and a cap removably couplable to the container body, the sifter having a contoured upper surface and a plurality of apertures configured for pass-through of cosmetic powder; and a cover member coupled to the cap and positioned adjacent the contoured upper surface of the sifter, the cover member having a first sweeper projecting toward the sifter, wherein the first sweeper is configured to direct the cosmetic powder on the contoured upper surface toward the plurality of apertures upon rotation of the cap such that the cosmetic powder passes through to the container body.

12. The cosmetic powder container of claim 11, wherein the sifter is domed-shaped and the contoured upper surface is concave.

13. The cosmetic powder container of claim 11, wherein the cap further comprises a plurality of bristles extending away from the sweeper, the bristles configured for collection of cosmetic powder and subsequent application of the cosmetic powder to a skin portion.

14. The cosmetic powder container of claim 13, further comprising a dust cap removably couplable to the cap, the dust cap configured to surround and protect the plurality of bristles.

15. The cosmetic powder container of claim 11, further comprising a second sweeper arranged in a circular arc around a center of the cover member.

16. The cosmetic powder container of claim 15, wherein the first sweeper and the second sweeper are spaced 180° apart along the circular arc such that a 180° rotation of the cap results in a swept path of 360° of the circular arc.

17. The cosmetic powder container of claim 16, further comprising a third sweeper, a fourth sweeper, and a fifth sweeper arranged in a circular arc around a center of the cover member, wherein the first, second, third, fourth, and fifth sweeper are spaced 72° apart along the circular arc such that a 72° rotation of the cap results in a swept path of 360° of the circular arc.

18. The cosmetic powder container of claim 11, wherein the removable coupling of the cap to the container body is a mechanical coupling selected from the group consisting of threads, press fit, turn-to-lock, and interlock.

19. The cosmetic powder container of claim 11, wherein the first sweeper abuts the concave upper surface of the sifter during at least a portion of the rotation of the cover member.

20. The cosmetic powder container of claim 11, wherein the first sweeper is manufactured from a material selected from one or more of High-Density Polyethylene (HDPE), Low-Density Polyethylene (LDPE), Linear Low-Density Polyethylene (LLDPE), rubber, Polypropylene (PP), nylon, Acrylonitrile Butadiene Styrene (ABS), Polybutylene Terephthalate (PBT), HYTREL®, and other thermo plastic or polymer.

* * * * *